United States Patent [19]

Hirata

[11] 4,349,268

[45] Sep. 14, 1982

[54] ELECTROSTATIC IMAGE-FORMING PROCESS AND AN APPARATUS THEREFOR

[75] Inventor: Masao Hirata, Hino, Japan

[73] Assignee: Konishiroku Photo Industry Co., Ltd., Japan

[21] Appl. No.: 163,268

[22] Filed: Jun. 26, 1980

[30] Foreign Application Priority Data

| | | | |
|---|---|---|---|
| Jun. 28, 1979 | [JP] | Japan | 54-80780 |
| Jul. 16, 1979 | [JP] | Japan | 54-89284 |
| Jul. 16, 1979 | [JP] | Japan | 54-89285 |
| Jul. 16, 1979 | [JP] | Japan | 54-89286 |
| Jul. 19, 1979 | [JP] | Japan | 54-90927 |

[51] Int. Cl.[3] ..... G03G 15/01

[52] U.S. Cl. ..... 355/4; 355/3 R; 430/42; 430/48

[58] Field of Search ..... 355/3 R, 3 TR, 4; 430/42, 48, 126

[56] References Cited

U.S. PATENT DOCUMENTS

| | | | |
|---|---|---|---|
| 3,692,519 | 9/1972 | Takahashi | 430/42 |
| 3,775,106 | 11/1973 | Tamai et al. | 430/42 X |

*Primary Examiner*—Fred L. Braun

*Attorney, Agent, or Firm*—Linda G. Bierman; Jordan B. Bierman

[57] ABSTRACT

A method of forming an electrostatic image of an original having both black and color portions includes selective elimination of the black portion to produce individual color electrostatic images which can be separately developed with respect to another image of the black portion, thereby increasing the definition and clarity of the resulting reproduction. Apparatus for carrying out the method of the invention are also described in detail.

22 Claims, 18 Drawing Figures

ELECTROSTATIC IMAGE-FORMING PROCESS AND AN APPARATUS THEREFOR

BACKGROUND OF THE INVENTION

The present invention relates to a method for forming an electrostatic image and, more particularly, to a method for forming an electrostatic image of an original having black and colored portions, wherein the black portion is selectively eliminated from the electrostatic image. The present invention also relates to an apparatus therefor.

In the formation of a color copy from an original having both black and colored portions by an electrophotographic process, it is generally desirable for the black portion to be reproduced with black toner alone. The reason for this preference is that it is practically impossible to reproduce true black by the mixture of three different toners representing the primary colors. Moreover, where the black image is reproduced by superposingly applying black toner on color toner, it is difficult to effect complete registration or coincidence of the black image with the color image. This is actually the case when a color original with a black portion to be copied contains a line, a letter, a character, or the like.

According to known methods for the formation of a color copy of an original having both black and colored portions by an electrophotographic process, an electrostatic image corresponding only to the black portion of the original can readily be obtained by imagewise projecting a light image of the original through three primary color filters onto a uniformly charged photoconductive member. However, it is difficult to form an electrostatic image of the original in which only the black image portion is eliminated, because the black image portion absorbs all of the visible rays; as a consequence, such image formation has heretofore been possible only by means of a complex process utilizing, for example, a negative image of the black portion.

In view of this current state of the art, the primary object of the present invention is to provide a method for forming an electrostatic image of an original having both black and color image portions, wherein the electrostatic image corresponding to the black portion of the original can be easily and effectively eliminated.

Another object of the present invention is to provide an electrophotographic apparatus suitable for producing a color copy of a dichromatic or multi-chromatic original containing a black portion therein. According to the present invention, since the electrostatic image corresponding to the color portion and the black portion of the original can be separately and independently obtained, it is possible for the electrostatic images of these portions to be developed with different toners of different colors independently but successively so that a clear copy of the original having black and colored portions can be obtained by means of a relatively simple electrophotographic process.

For example, a two-color or multicolor copy image in which the black image portion is clearly reproduced can be obtained by combining a process for developing an electrostatic image using toner of the same color as that of the color image portion of an original, or repeating the same for each of the multicolor image portions of the original, with a process for developing, with black toner, an electrostatic image corresponding to the black image portions of the original.

Thus, the present invention more specifically relates to a method for the formation of an electrostatic image of an original having black and color portions, wherein the black portion is selectively eliminated from the electrostatic image, and comprising:

(a) forming a first electrostatic image corresponding to the black and color portions of the original on a first recording material capable of bearing an electrostatic charge thereon;

(b) forming a second electrostatic image corresponding to the black portion of the original on a second recording material capable of bearing an electrostatic charge thereon, the second electrostatic image being a reflected image with respect to the first electrostatic image; and (c) eliminating the electrostatic image corresponding to the black portion of the first electrostatic image either by superposing the first recording material on the second recording material, or by placing the first recording material in close proximity to the second recording material, so that the electrostatic image of the black portion of both the first and second recording materials face each other, and by impressing on the first electrostatic image an electric charge of a polarity opposite that of the first electrostatic image either by direct use of the second electrostatic image or by use of the second electrostatic image as a control medium.

The invention further relates to an apparatus for carrying out the foregoing method.

According to one of the preferred embodiments of the present invention, the method comprises:

(a1) forming a first electrostatic image corresponding to the black and color portions of the original on a first recording material capable of bearing an electrostatic charge thereon;

(b1) forming a second electrostatic image of the same charge polarity as that of the first electrostatic image on a second recording material capable of bearing an electrostatic charge thereon, the second recording material being a screen member which controls a flow of electrically charged particles only in the region corresponding to the black portion of the original, and the second electrostatic image being a reflected image with respect to the first electrostatic image; and (c1) eliminating the electrostatic charge in the region corresponding to the black portion of the first electrostatic image either by superposing the first recording material on the second recording material, or by placing the first recording material in close proximity to the second recording material, so that the electrostatic image of the black portion of both the first and second recording materials face each other, and by projecting a flow of charged particles having an opposite polarity with respect to that of the first electrostatic image onto the first electrostatic image through the second recording material.

According to another preferred embodiment of the present invention, the method comprises:

(a2) forming a first electrostatic image corresponding to the black and color portions of the original on a first recording material capable of bearing an electrostatic charge thereon;

(b2) forming on a second recording material an electrostatic image corresponding to the black portion of the original and having an opposite polarity with respect to the first electrostatic image, the second electrostatic image being a reflected image with respect to the first electrostatic image; and (c2) eliminating the electrostatic image corresponding to the black portion of the first electrostatic image either by superposing the first recording material on the second recording material, or by placing the first recording material in close proximity to the second recording material, so that the electrostatic image of the black portion of both the first and second recording materials face each other, and by effecting on the first electrostatic image an electric charge of the second electrostatic image.

In practicing the present invention, the first recording material may be any sheet material capable of bearing an electrostatic charge on its surface. Thus, it may comprise any conventional photoconductive plate having a photoconductive layer on an electrically conductive support—including a so-called screen type photoconductive plate which comprises an electrically conductive substrate having a plurality of holes therethrough and a photoconductive layer on one surface of the conductive substrate—or alternatively it may comprise a sheet material consisting of an insulating substance onto which an electrostatic image can be transferred from the photoconductive plate.

The second recording material may be formed the same as the first recording material. It is preferred, however, that the aforementioned screen-type photoconductive plate be employed for the second material, especially when the processes described above as (b1) and (c1) are employed in the image formation procedure. Where the processes described as (b2) and (c2) are employed, on the other hand, any of those plate types or structures which can be used for the first recording material may be utilized. From a practical point of view, a photoconductive plate may advantageously be employed.

The present invention is now disclosed and illustrated with examples wherein a two-color reproduction image is formed from an original having both black and red image portions, with reference to the drawings, wherein:

FIG. 1 semi-schematically depicts a first photoconductive plate being initially charged;

FIG. 2 depicts exposure of the first photoconductive plate of FIG. 1 to light reflected from an original in accordance with the invention;

FIG. 3 diagramatically depicts a cross-section of a second photoconductive screen-type plate;

Figure 17:
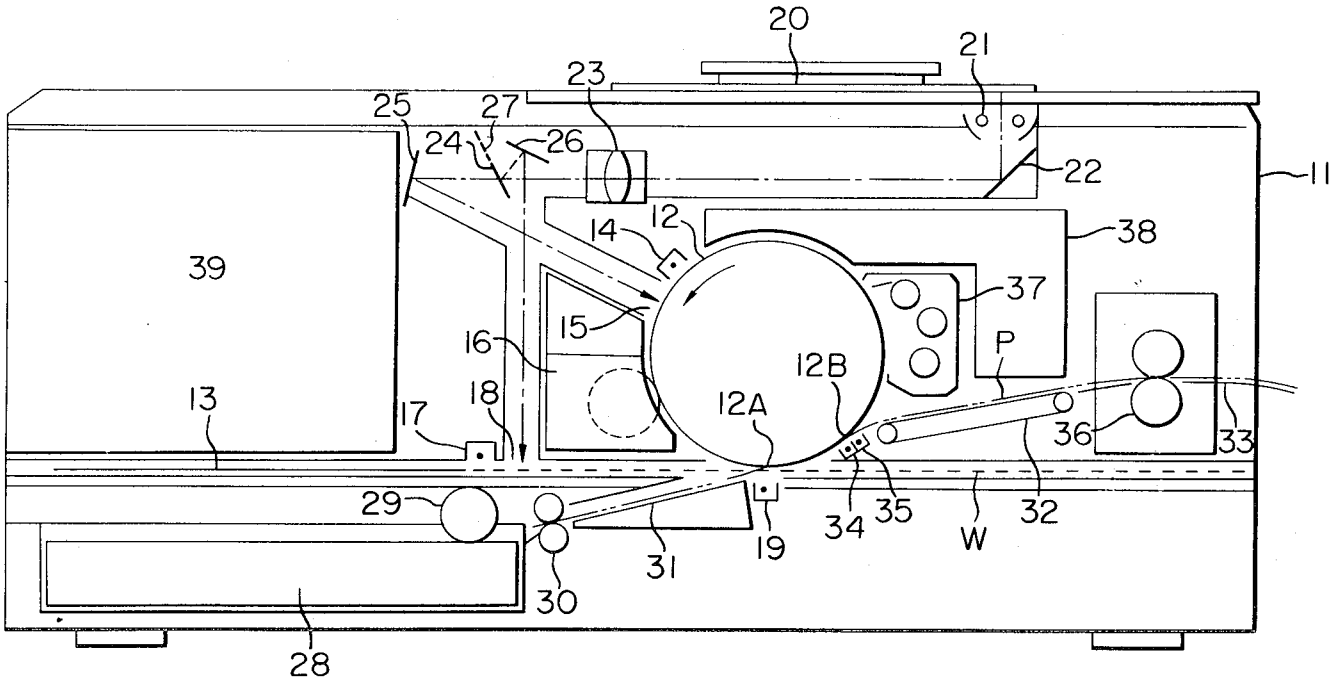
Figure 18:
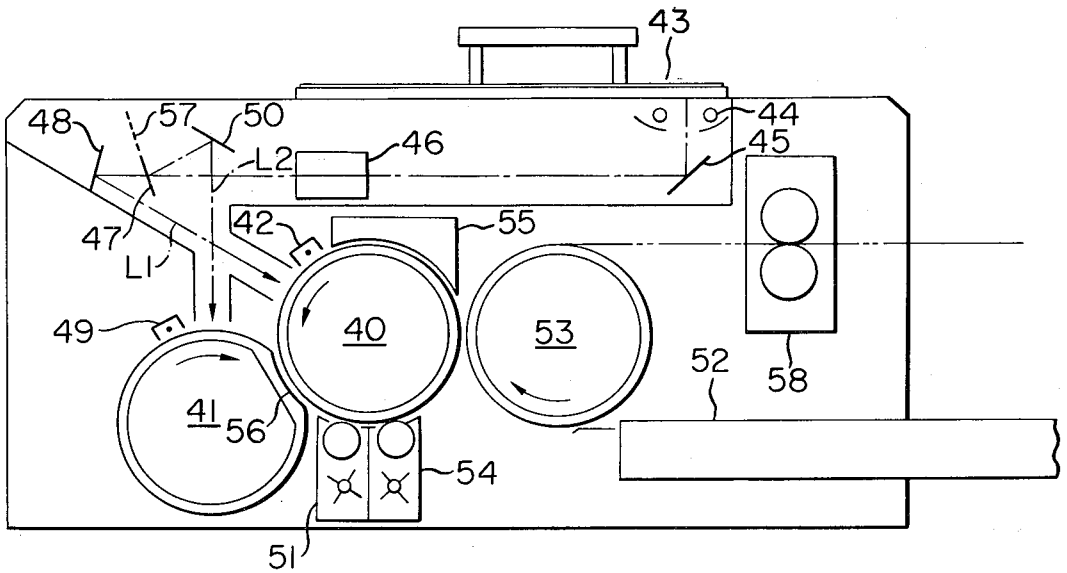

FIG. 17 diagramatically depicts an apparatus for carrying out one form of the invention; and FIG. 18 diagramatically depicts an apparatus for carrying out another form of the method of the invention.

DETAILED DESCRIPTION OF THE PREFERRED EMBODIMENTS

Figure 1:
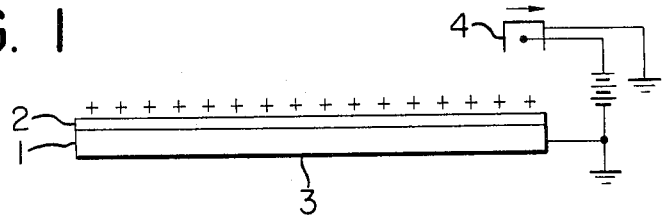
Figure 2:
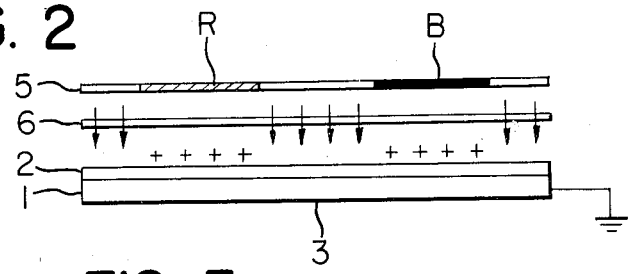

In FIG. 1, a photoconductive plate 3 comprises an electrically conductive support 1 carrying a photoconductive layer 2 of, for example, selenium alloy. Layer 2 is uniformly positively charged by a corona charger 4 while its conductive support 1 is grounded and then, as shown in FIG. 2, photosensitive layer 2 is image-wise exposed through a cyan filter 6—of the complementary color to red—to the light reflected from an original 5 having both a black portion B and a red portion R. In this manner, the area of photoconductive layer 2 corresponding to other than both the black portion B and the red portion R are exposed to light, freeing or neutralizing the electrostatic charge and thereby forming a first electrostatic image having a positive charge corresponding to the black portion B and the red portion R of the original.

Figure 3:
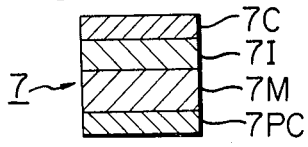
Figure 4:
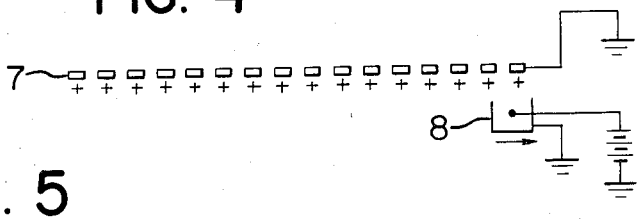
FIG. 4 depicts exposure of the screen of FIG. 3 to light reflected from the original in accordance with the invention.

Another or second photoconductive plate 7 may be implemented as a screen-type photoconductive plate, a typical construction of which is shown in FIG. 3. Screen 7, as illustrated, comprises a conductive mesh member 7M, a photoconductive layer 7PC formed, for example, of selenium on one surface of mesh member 7M, an insulating layer 7I provided on the other or opposite side of mesh member 7M, and a conductive bias layer 7C. As shown in FIG. 4, photoconductive plate 7 is uniformly and positively charged, while conductive mesh member 7M is grounded, by a corona charge 8. Light reflected from the original 5 is then imagewise projected (FIG. 5) through a red filter 9 onto photoconductive layer 7PC of screen 7; in this manner a second electrostatic image having the same polarity as that of the first electrostatic charge is formed on photoconductive layer 7PC in the region corresponding solely to black portion B such that the electrostatic image thus projected on screen 7 is a reflected or mirror image with respect to that on first recording material or plate 3.

Figure 6:
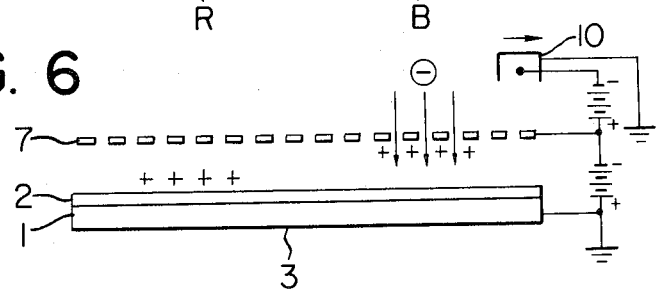
FIG. 6 depicts placement of the first and second photoconductive plates in facing relation and passage of a flow of charged particles therethrough in the inventive method.

Referring now to FIG. 6, screen 7 is next disposed so that photoconductive layer 7PC bearing the second electrostatic image is disposed in facing relation to photoconductive layer 2 of photoconductive plate 3 bearing the first electrostatic image. Then, while applying a bias voltage of appropriate magnitude and of the same polarity as that of the second electrostatic image to conductive layer 7C of screen 7, a flow of negatively charged particles from a charger 10 is projected through screen 7 onto sensitive layer 2 utilizing the electric field provided between plate 3 and charger 10; the flow of negatively charged particles flowing from charger 10 is thereby permitted to pass through screen 7 in the region where positive electric charge is present, but is prevented from passing through the screen in areas other than that region, thereby enabling elimination of the positive electrostatic charge only in that region corresponding to the black image portion B of the first electrostatic image. As a consequence, an electrostatic image free of the black portion—and having electrostatic charge only in the region corresponding to the red image portion R—is obtained. In practicing the present invention, any conventional or known screen-type photoconductive plates—as, for example, those described in Japanese Laid-Open Patent Publications No. 48-59840/1973 and No. 50-36137/1975, or in U.S. Pat. No. 3,713,734 and No. 3,680,964—may be used.

Figure 7:
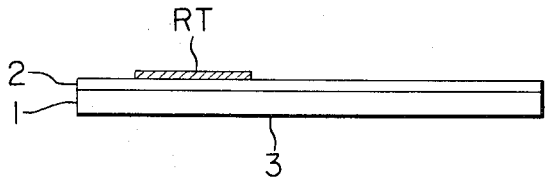
FIG. 7 depicts a red toner image of the original on the first photoconductive plate.
Figure 8:
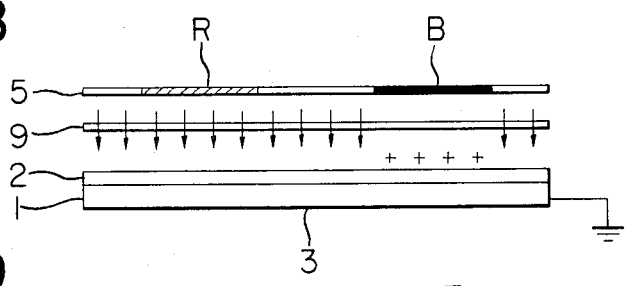
FIG. 8 depicts the inventive procedure for forming a black electrostatic image of the original on the first photoconductive plate.

Thus, an electrostatic image of the red portion R of the original can be formed—and a red toner image RT obtained by developing such electrostatic image with red toner—on photoconductive plate 3 as shown in FIG. 7. In order to reproduce a black image, a separate process for forming the black image can be utilized as shown in FIG. 8. More particularly, after photoconductive layer 2 of first photoconductive plate 3 is uniformly positively charged by means of corona charger 4 (FIG. 1), the light image from original 5 is imagewise projected through red filter 9 onto plate 3 to form an electrostatic image having positive charge only in the region corresponding to the black portion B of original 5. The electrostatic image thus formed is then developed with black toner to obtain black toner image BT as shown in FIG. 9.

Figure 9:
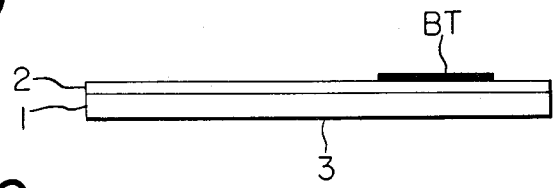
FIG. 9 depicts a black toner image of the original an the first photoconductive plate.
Figure 10:
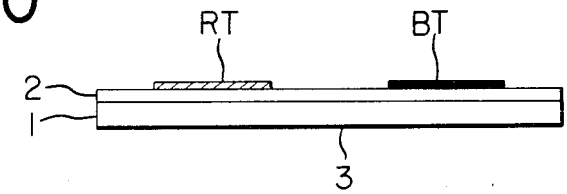
FIG. 10 depicts the red and the black toner images of the original on the first photoconductive plate.
Figure 11:
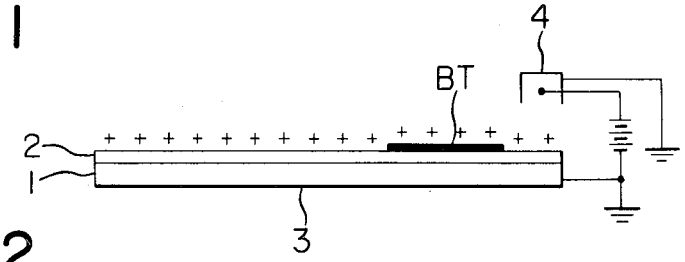
FIGS. 11 to 13 depict a form of the inventive method wherein the black toner image is completed before the process of reproducing the red toner image on the same photoconductive plate is carried out.
Figure 12:
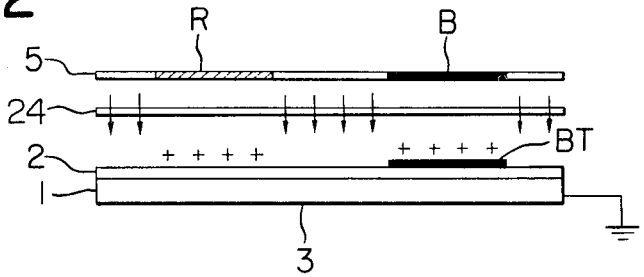
Figure 13:
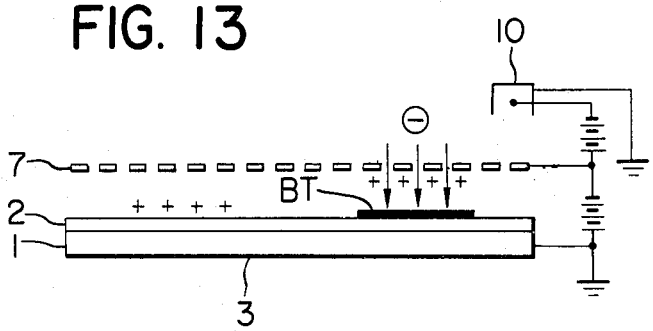

Accordingly, in order to form a two-color reproduction image corresponding to an original 5 having both a black portion B and a red portion R, two image forming processes are employed and combined—a first process for forming red toner image RT (FIGS. 1 through 7) and a second process for forming black toner image BT (FIGS. 1, 8 and 9). A complete copy of original 5 is obtained, after the process for forming red toner image RT and that for forming black toner image BT are individually carried out, by separately transferring and fixing these respective toner images onto the same transfer sheet. Alternatively, after black toner image BT has been formed, the process for forming red toner image RT may be carried out as shown in FIGS. 11 through 13 to together form both black toner image BT and red toner image RT on the same photoconductive plate (FIG. 10), the combined toner images BT and RT being then transferred to and fixed on a transfer sheet.

Figure 14:
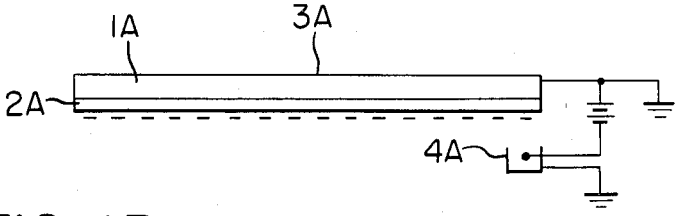
FIGS. 14 to 16 depict another form of the inventive method.
Figure 15:
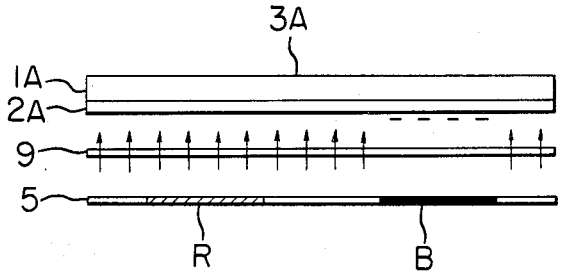
Figure 16:
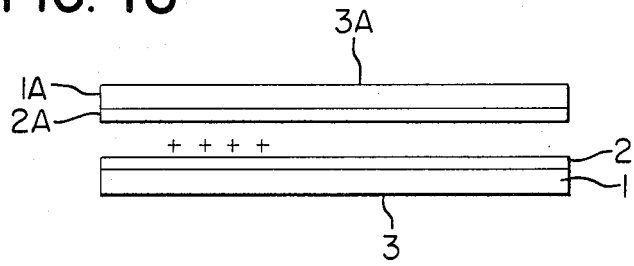

FIGS. 1, 2 and 14 through 16 illustrate another embodiment of the present invention, namely the method in which processes (a2) through (c2) are employed. In this specific process the first method step (a2) is carried out in the same manner as step (a1) hereinbefore described with reference to FIGS. 1 and 2. Referring now to FIG. 14, after a photoconductive layer 2A of a second photoconductive plate 3A is uniformly negatively charged by means of a charger 4A, light exposure from the original 5 which contains both a red portion R and a black portion B is effected on negatively charged photoconductive layer 2A through red filter 9 (or a so-called dichroic filter) to thereby form a negative charge electrostatic image—which is a reflected image with respect to the first electrostatic image—corresponding to the black portion of the original. In the next step (c2) as shown in FIG. 16, second recording material 3A is superposed on first recording material 3 or, alternatively, second recording material 3A is placed in close proximity to first recording material 3, so that the electrostatic image of the black protion of photoconductive layers 2 and 2A of the first and second recording materials face each other, to thereby eliminate the electrostatic image corresponding to the black portion of first recording material 3. As a result, an electrostatic image corresponding only to the red portion R of the original 5 is obtained. By subsequently repeating the developing process hereinbefore described with reference to FIGS. 7 through 13, two-color or multi-color copies of the original containing a black portion therein can be obtained.

FIG. 17 illustrates an apparatus for use in performing the inventive image forming process. The apparatus includes a rotary photoconductive drum member 12 as the first recording material and comprising a peripheral photoconductive layer on a conductive drum surface, and a flat screen-type photoconductive plate 13 as the second recording material movable along a linear screen path W which includes a portion facing and opposite the peripheral photoconductive layer of rotary drum member 12. There is further provided a charger 19 for projecting charged particles onto the peripheral photoconductive layer of drum 12 through screen-type plate 13, the plate 13 being disposed opposite to the peripheral photoconductive drum layer, and a pair of developing units 16 and 37 for developing an electrostatic image formed on the peripheral layer of drum member 12. The apparatus also includes a mechanism for transporting a transfer sheet—onto which a visible toner image developed on drum member 12 is to be transferred—along a transfer sheet path P situated closely adjacent drum member 12, and a mechanism for imagewise projecting the light from an original on both rotary photoconductive member 12 and screen-type photoconductive plate 13 by means of a dichroic filter 24 which is interchangeably disposed with a red filter 27 in the image light path. The presence of filters 24, 27 enables separation of the image light into a first image light of a color corresponding to one of the colors of the original and a second image light of the complementary color with respect to the first image light, the first image light being projected onto screen-type plate 13 through a first light path 18 and the second image light being projected onto rotary photoconductive member 12 through a second light path 15.

More specifically, a housing 11 of the copying apparatus is provided therein with a rotary photoconductive drum member 12 rotatable about a horizontal axis and having a peripheral photoconductive layer formed, for example of selenium, and further with a flat screen-type photoconductive plate 13 constructed as shown in FIG. 3 and horizontally movable along a linear screen path W (illustrated in broken line), the path W including a portion facing and opposite the bottom portion 12A of drum member 12. Moving counterclockwise along the periphery of drum member 12, a corona charger 14 for the drum, second light path 15, and first developing unit 16 are successively provided.

Screen 13 is adapted to be moved congruent to the advancing direction of bottom portion 12A of drum member 12, and corona charger 17 for screen-type plate 13 and first light path 18 are provided on the side of the drum reached prior to the concurrence of bottom portion 12A and screen path W as drum 12 operatively rotates (i.e. on the left in the drawing). Charger 19 is disposed so as to face opposite drum bottom portion 12A with screen path W therebetween. In addition, a movable original table 20 is provided on housing 11 of the apparatus, and an optical mechanism directs the light reflected from an original placed on original holder or table 20 toward both first light path 18 and second light path 15. The optical mechanism in the example shown in the drawing includes a lamp 21, a mirror 22, a projection lens 23, a dichroic filter 24, mirrors 25 and 26—the latter two directing the light transmitted and reflected from diachroic filter 24 toward the first light path 18 and the second light path 15, respectively—and a color filter 27 for interchangeable use whenever necessary in place of dichroic filter 24.

As further illustrated in FIG. 17, a paper feeding tray 28 is removably located beneath the starting position of screen-type photoconductive plate 23, and the transfer sheet path P (seen in alternating long and two short dashes representation) along which paper is transported from feeding tray 28 by means of feeding roller 29 extends obliquely upward and intersects screen path W in the proximity of drum bottom portion 12A. Transfer sheet path P thereafter coincides with a transfer portion 12B slightly rotatedly spaced from drum bottom portion 12A, and then further extends therefrom and continues along and over the path for screen-type plate W, with a paper feeding roller 30, a delivery guide 31, a transport belt 32, and a paper ejecting guide 33 being provided to further transport the paper along path P. An electrode 34 for image transfer faces opposite image transfer portion 12B with path P therebetween, another electrode 35 for sheet separation is disposed adjacent electrode 34, and an additional roller 36 for image fixing is provided between transport belt 32 and ejecting guide 33.

Moving in the counterclockwise direction from separation electrode 35 about the peripheral surface of drum member 12, a second developing unit 37 and a drum cleaner 38 are successively disposed, cleaner 38 being located between developer 37 and corona charger 14 for the drum. A control circuit 39 for controlling the operation of each of the foregoing members is provided in the space above the starting or nonoperating position of screen-type photoconductive plate 13.

Use of this image forming apparatus enables formation of a copy image from an original having both black and red portions in such manner that, for example, during a first revolution of drum member 12, drum support 1 is grounded while its photoconductive layer 2 is uniformly and positively charged by means of corona charger 4 (FIG. 1). In addition, and as shown in FIG. 8, the light from the original 5 having both a black portion B and a red portion R is projected onto photoconductive layer 2 through a red filter 27 interposed in the light path, thereby forming a first electrostatic image corresponding to black portion B, which image is then developed with black developer in developing device 16 to produce a visible black image BT as seen in FIG. 9. During this period of time other devices of the apparatus remain out of operation.

Next, in the second revolution of rotary drum member 12, as shown in FIG. 11, photoconductive layer 2 bearing visible image BT is charged in the same manner as in the first revolution, and again the light from original 5 is projected onto photoconductive layer 2 through dichroic filter 24—in place of filter 27—interposed in the light path, the dichroic filter serving as a cyan filter for the transmitted light. In this maner, a light image of original 5, due to the absorption of red portion R, is formed as is black image B with a preliminary electrostatic latent image corresponding to that of red image portion R on photoconductive layer 2.

Figure 5:
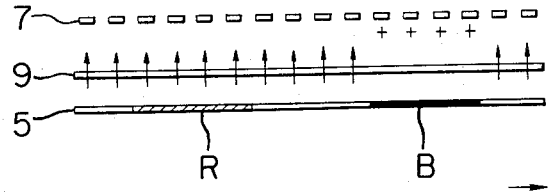

Flat screen-type photoconductive plate 13 begins its movement along path W in sychronization with the start of the second revolution of rotary photoconductive drum member 12. As shown in FIG. 4—and with conductive mesh 7M grounded—photoconductive layer PC is uniformly positively charged by means of corona charger 8 (designated 17 in FIG. 17), and is then exposed to the light image of original 5 obtained as a reflection from dichroic filter 24. At this stage, serving as a cyan filter for the transmitted light, dichroic filter 24 serves as a red filter for the reflected light and, as a result, the light from the red image portion R of original 5 is projected onto photoconductive layer 7PC (FIG. 5). A control electrostatic image corresponding only to the black image portion B is thereby formed on photoconductive layer 7PC of screen-type photoconductive plate 7.

The length of the light path from dichroic filter 24 through mirror 25 to photosensitive layer 2 of drum member 12 is identical to that of the other light path extending from filter 24 through mirror 26 to photoconductive layer 7PC of screen-type plate 13. In addition, the light advancing toward screen-type plate 13 is reflected once more than the light directed toward photoconductive layer 2, so that the former is a reflected or mirror image with respect to the latter.

While screen-type photoconductive plate 13, on which the electrostatic image is formed, is further moved and brought to a position facing and opposite the bottom portion 12A of drum member 12, drum 12 is rotated to carry the electrostatic image it bears to face screen 13 and charger 19. By making the moving speed of screen-type plate 13 and the distance between its exposure position and its position opposite bottom portion 12A of drum 12 equal to the rotated speed of the peripheral surface of drum member 12 and the distance between its exposure position and its bottom portion 12A, respectively, operative movement of layer 2 and screen 13 are synchronized so that the electrostatic image formed on each are carried into superposd relation with complete coincidence. Accordingly, as shown in FIG. 13, when negatively charged particles flowing from charger 10 are projected through screen-type plate 7 onto photoconductive layer 2 while the conductive bias layer 7C of the screen is impressed with an apporpriate bias voltage of the same polarity as that of the screen-carried electrostatic image, the charged particle flow is controlled by screen-type member 7 so that passage of charged particles therethrough is permitted only in that region bearing the positive charge of the electrostatic image on photoconductive layer 7PC. The visible black toner image BT with positive charge on photoconductive layer 2 is thereby subjected to a flow of negatively charged particles which cancel its positive charge, so that a latent image corresponding only to the red portion R is formed. This electrostatic image is then moved by revolution of rotary drum member 12 to second developing device 37 for development with red developer, resulting in the presence of both visible red image RT and visible black image BT on photoconductive layer 2, as shown in FIG. 10.

In the present invention, the use of a non-abrasion type developing unit—such as a cascade type unit—to implement second developing device 37 is desirable for the reason that it exerts no bad or deteriorating influence upon a previously formed image.

Subsequently, in the third revolution of rotary drum member 12, transfer of the toner image takes place. A transfer sheet is supplied from a feeding tray 28 synchronously with the start of the third revolution, is moved along path P by means of first and second paper feed rollers 29, 30 and is directed beyond screen path W into contact with drum member 12 at transfer portion 12B, at which visible images BT and RT are transferred to the sheet by actuation of transfer corona electrode 34. The transfer sheet is then separated from rotary photoconductive drum member 12 by actuation of separation corona electrode 35 and directed by paper conveyance unit 32 to roller 36 for image fixing, being thereafter ejected by paper delivery guide plate 33 to yield a copy image of the original.

In this invention, it is preferable that the apparatus be designed so that the path W—along which screen-type plate 13 is moved into opposed and closely facing relation to the peripheral surface of drum member 12—intersects the path P—along which the transfer sheet is moved into contact with the peripheral surface of drum member 12—at the bottom or lowermost level of rotary drum member 12, thereby enabling a reduction in size of the apparatus. This further aims at avoiding the situation where movement of the image-bearing surface regions of drum 12 and screen 13 into facing super position occurs simultaneously with bringing of the transfer sheet into contact with the drum's peripheral surface. Thus, the positions opposite bottom portion 12A and image transfer portion 12B (at which the transfer paper is brought into contact with the drum surface) may be disposed closer to each other, so that other regions of the peripheral surface of rotary conductive drum member 12 are available for effective utilization in, for example and as shown in the drawing, having a plurality of developing units located about the drum.

Further, such an arrangement may allow the path W for screen 13—which is liable to be deformed—to be flat, and it may further permit avoidance of large curved portions in sheet path P. As a consequence, movement of each of the recording materials can be smoothly effected, the life of screen 13 will be extended since it is maintained flat, and the transfer sheet will tend to be neither wrinkled nor curled owing to incomplete moving action of the recording materials.

In contrast, where screen path W and sheet path P are both made linear and are provided independently of each other with respect to rotary drum member 12, the peripheral surface of drum 12 would be largely restricted by them, necessitating the provision of a rotary drum with much larger diameter in order to accommodate other required devices and causing the apparatus to be very large and to include useless space.

In the present invention, screen-type plate 13 must return to its initial position after use in preparation for subsequent image formation. If such return is carried out when the transfer sheet has been completely removed from drum member 12, there will be no possibility of the returning screen-type plate 13 striking or hindering the movement of the transfer sheet. For example, in the foregoing process, screen-type photoconductive plate 13 may be returned to its starting position at the time of first rotation of drum member 12 in a subsequent image formation process.

As mentioned, the use of the described image forming apparatus of FIG. 17 not only enables the machine to be relatively small with a very simple constitution—while nevertheless having a rotary photoconductive drum member as well as a screen-type photoconductive plate disposed relative thereto—but also provides stable image formation without shortening the life of the screen-type photoconductive plate.

Another characteristic feature of the apparatus for the image-forming process of the present invention with reference to FIG. 17 is in the exposure mechanism using a dichroic filter.

In the present invention, housing 11 is provided on its uppermost surface with a movable original table 20 and an optical exposure mechanism which introduces the light from an original placed on table 20 to both first light path 18 and second light path 15. This optical exposure mechanism comprises light source 21 which illuminates the original, mirror 22 from which the image of the original is reflected into projection lens 23, dichroic filter 24 which is disposed on the optical axis of projection lens 23 on its light transmission side, and mirrors 25 and 27 which reflect light transmitted through and reflected from dichroic filter 24 and lead the respective light rays to the second and first light paths, respectively.

The length of the light path from dichroic filter 24 through mirror 25 to photoconductive drum member 12 is equal to that from filter 24 through mirror 26 to screen-type photoconductive plate 13. And, as illustrated in FIG. 12, the number of reflections of the light directed toward the first light path 18 is such that a reflected or mirror image is obtained with respect to the image presented at the end of the second light path 15.

Further, and in connection with dichroic filter 24, a color filter 27 is also provided interchangeably with dichroic filter 24.

Also in the present invention, a first electrostatic image—corresponding to the first image portion—formed on the first recording material (rotary drum member 12) may be developed with toner of a first color in an optionally selected developing unit or method. However, when this first recording material bearing the first visible toner image is then impressed with a second electrostatic image corresponding to the second image portion (which is thereafter subject to a second development with toner of the second color), it is preferred that this second development be carried out in a non-abrasion type developing unit or method so as to prevent degradation of the first-formed toner image.

A non-abrasion type developing unit here means one in which development takes place under such conditions that the surface of the recording material carrying an electrostatic image is not forcibly rubbed during development with its own component or developer, and includes impression type, powder-cloud type and cascade-type developing units.

FIGS. 1, 2, 14 through 16 and 18 illustrate a method and apparatus for performing another preferred embodiment of the present invention—namely, the steps previously designated (a2) through (c2). FIG. 18 shows an electrophotographic apparatus capable of forming a two-color printed copy image with the use of this alternate method of the invention. The apparatus is provided with a first photoconductive drum 40 as a first recording material, and a second photoconductive drum 41 as a second recording material, so that the respective peripheral drum surfaces are disposed close to and are revolved in opposite directions with respect to each other. In this embodiment, the following operations are carried out while these photoconductive drums 40 and 41 are revolving. As shown in FIG. 1, photoconductive layer 2 formed on the peripheral surface of first photoconductive drum 40 is uniformly charged—e.g., positively, by a charger (42 in FIG. 18). The image light obtained by illuminating original 5 (in FIG. 2) placed on movable original table 43 by means of light source 44 is imagewise projected through mirror 45 and projection lens 46 and directed to dichroic filter 47 which functions as a cyan filter for the transmitted light, as shown in FIG. 2. The transmitted light from dichroic filter 47 is then projected through mirror 48 onto charged photoconductive layer 2. Consequently, the transmission of red light is permitted by dichroic filter 47, so that the light is projected onto an area of photoconductive layer 2 corresponding to the black portion B and the red portion R of original 5, thus forming a first positively charged electrostatic image corresponding to both the black portion B and the red portion R.

At the same time, as shown in FIG. 14, photoconductive layer 2A formed on the peripheral surface of second photoconductive drum 41 is uniformly negatively charged (in a polarity opposite that of first photoconductive drum 40) by means of second charger 49. The reflected light from dichroic filter 47 is then projected on the charged photoconductive layer 2A through mirror 50. Thus, dichroic filter 47 functions as a red filter (red being a complementary color with respect to cyan) for the reflected light so that photosensitive layer 2A is exposed to light only in the region corresponding to black portion B, thereby forming a second electrostatic image of negative charge.

In the foregoing process, the length of light path L1 from projection lens 46 through dichroic filter 47 and mirror 48 to first drum 40 is made equal to the length of light path L2 from the lens 46 through filter 47 and mirror 50 to second drum 41, and the number of reflections of the light directed toward first drum 40 is set to be an even number (two reflections in the case of the drawings) while that of the light directed toward second drum 41 is set to be odd, whereby the second electrostatic image is a reflected or mirror image with respect to the first electrostatic image.

First photoconductive drum 40 and second drum 41 bearing the first and second electrostatic images, respectively, are revolved at equal speeds, their respective peripheral surfaces being brought into contact with each other at a position equally removed or spaced from their respective exposure points. At such contact position—and as shown in FIG. 16—the positive charge in the black portion of the first electrostatic image is neutralized or canceled by the negative charge corresponding to the black portion of the second electrostatic image, thereby resulting in loss or removal of the black portion and the consequent formation of an electrostatic image corresponding only to the red portion of original 5 on photoconductive layer 2 of first drum 40.

In this process, the charge in the black portion of the first electrostatic image may also be lost or removed by means of the so-called Paschen's discharge generated by bringing the peripheral surfaces of both photoconductive drums 40 and 41 close to each other at an approximate distance of less than 0.1 mm, without contact therebetween.

When an electrostatic image free of the black portion is formed in the foregoing manner, this electrostatic image may be developed by a first developing unit 51 containing red toner, and the resulting visible red toner image then transferred to a transfer sheet carried on a transfer drum 53 functioning to hold and transport paper drawn from a paper feeding tray 52. During this time, a second developing unit 54 containing black toner and disposed adjacent first developing unit 51 is maintained inoperative—in the case of a magnetic brush type unit, for example, by reverse rotation to prevent formation of a bristle. Meanwhile, the transfer sheet onto which the image has been transferred is held on transfer drum 53 until a subsequent image transfer is completed. The first photoconductive drum 40 which has completed the preceding transfer operation is cleared of the attached toner by means of drum cleaner 55 and is readied for the subsequent process.

Reproduction of the black portion of original 5 is thereafter carried out on first photoconductive drum 40, second photoconductive drum 41 being kept out of operation this time so as to avoid affecting or influencing first photoconductive drum 40—this may be accomplished, for example, by providing a recess 56 on the drum's peripheral surface (FIG. 18) and nonrotatively holding drum 41 so that its recess 56 is disposed adjacently opposite drum 40. In addition, after first drum 40 is rotated to charge its photoconductive layer 2 (as in FIG. 1), dichroic filter 47 is replaced by red color filter 57 and the light from original 5 is imagewise projected through red filter 57 onto photoconductive layer 2.

In this manner, the light corresponding to red portion R of original 5 is not projected onto photoconductive layer 2; hence on photoconductive layer 2 an electrostatic image corresponding only to the black portion B is formed. This electrostatic image is developed by second developing unit 54 containing black toner and the visible image thereby obtained is transferred onto the transfer sheet, on which the red toner image has already been formed, on transfer drum 53. Thus, a toner image corresponding to both the black and red portions B and R of original 5 is formed on the transfer sheet, which is then transported to fixing device 58 to be fixed and is ejected, yielding a finished two-color copied image of original 5.

The formation of an electrostatic image in which the black portion is eliminated is readily achievable in accordance with the invention without any complex process such as the formation of negative images—which is disclosed, for example, in Japanese patent pre-examined publications No. 49-111/1974 and No. 49-640/1974—and the like, so that the color portion and the black image portion may each be reproduced by the use of a respective toner and a clear and fine two-color printed copy image can thus be obtained. According to the present invention, any color image other than red can be produced in a similar manner, and even an original having a plurality of color portions may be reproduced by applying the foregoing method to each of the different color image portions.

In this embodiment, it is necessary that the first and second electrostatic images be formed with opposite polarity charges, and it is noted that a photoconductive layer normally has definite polar charging characteristics according to its photoconductive material. Thus, as a photoconductive layer for retaining a positively charged electrostatic image, such materials as selenium, a selenium alloy such as selenium-tellurium, an insulating layer-coated cadmium sulfide, and certain organic substances may be used. As for the photoconductive material for retaining a negatively charged electrostatic image, such materials as zinc oxide, cadmium sulfide and certain organic substances may be used. It is convenient, therefore, to use photoconductive materials having positive charging characteristics for the first recording material, and such materials having negative charging characteristics for the second recording material. Since in the disclosed invention the first recording material is barely charged to an opposite polarity, by forming the second electrostatic image at a higher negative electric potential than the positive potential of the first electrostatic image for eliminating the charge corresponding to the black portion of the first electrostatic image, complete removal of the image portion may be achieved, and no charge of opposite polarity will remain on the first recording material; thus, it is very advantageous from a practical point of view.

In the present invention various kinds of filters may be used in projecting the image light from an original to form the first and second electrostatic images. These filters absorb or transmit the chromatic light from the color portion of the original. For this purpose a filter whose color is complementary with respect to that of the original or a filter whose color is the same as that of the original is preferable. In the disclosed embodiments a dichroic filter is advantageously employed since it is capable of dividing an image light from an original into two chromatic lights—i.e., a first light which is the same color as the colored portion of the original and a second in a complementary color with respect to the first. Each of the divided lights as such may be used for formation of the second and first electrostatic images, thereby rendering it possible to perform two exposure processes simultaneously.

As has been mentioned, the method and apparatus of the present invention enable formation of an electrostatic image in which the block portion is eliminated in a very simple manner, and of a copy image in which all of the image portions are excellently reproduced through development with a toner of corresponding color and by further reproduction of the black image portion of the original.

What is claimed is:

1. A method for forming an electrostatic image of an original having black and color portions, wherein the black portion is selectively eliminated from the electrostatic image, said method comprising:

(a) forming a first electrostatic image corresponding to the black and color portions of the original on a first recording material capable of bearing an electrostatic charge thereon;

(b) forming a second electrostatic image corresponding only to the black portion of the original on a second recording material capable of bearing an electrostatic charge thereon, said second electrostatic image being a reflected image with respect to the first electrostatic image; and (c) eliminating the electrostatic image corresponding to the black portion of the first electrostatic image by superposing the first recording material on the second recording material so that the electrostatic image of the black portion of both the first and second recording materials is disposed in facing relation to each other, and by impressing on the first electrostatic image an electric charge of polarity opposite that of the first electrostatic image by direct use of the second electrostatic image.

2. A method for forming an electrostatic image of an original having black and color portions, wherein the black portion is selectively eliminated from the electrostatic image, said method comprising:

(a) forming a first electrostatic image corresponding to the black and color portions of the original on a first recording material capable of bearing an electrostatic charge thereon;

(b) forming a second electrostatic image corresponding only to the black portion of the original on a second recording material capable of bearing an electrostatic charge thereon, said second electrostatic image being a reflected image with respect to the first electrostatic image; and (c) eliminating the electrostatic image corresponding to the black portion of the first electrostatic image by placing the first recording material in close proximity to the second recording material so that the electrostatic image of the black portion of both the first and second recording materials is disposed in facing relation to each other, and by impressing on the first electrostatic image an electric charge of polarity opposite that of the first electrostatic image by direct use of the second electrostatic image.

3. A method for forming an electrostatic image of an original having black and color portions, wherein the black portion is selectively eliminated from the electrostatic image, said method comprising:

(a) forming a first electrostatic image corresponding to the black and color portions of the original on a first recording material capable of bearing an electrostatic charge thereon;

(b) forming a second electrostatic image corresponding only to the black portion of the original on a second recording material capable of bearing an electrostatic charge thereon, said second electrostatic image being a reflected image with respect to the first electrostatic image; and (c) eliminating the electrostatic image corresponding to the black portion of the first electrostatic image by superposing the first recording material on the second recording material so that the electrostatic image of the black portion of both the first and second recording materials is disposed in facing relation to each other, and by impressing on the first electrostatic image an electric charge of polarity opposite that of the first electrostatic image by use of the second electrostatic image as a control medium.

4. A method for forming an electrostatic image of an original having black and color portions, wherein the black portion is selectively eliminated from the electrostatic image, said method comprising:

(a) forming a first electrostatic image corresponding to the black and color portions of the original on a first recording material capable of bearing an electrostatic charge thereon;

(b) forming a second electrostatic image corresponding only to the black portion of the original on a second recording material capable of bearing an electrostatic charge thereon, said second electrostatic image being a reflected image with respect to the first electrostatic image; and (c) eliminating the electrostatic image corresponding to the black portion of the first electrostatic image by placing the first recording material in close proximity to the second recording material so that the electrostatic image of the black portion of both the first and second recording materials is disposed in facing relation to each other, and by impressing on the first electrostatic image an electric charge of polarity opposite that of the first electrostatic image by use of the second electrostatic image as a control medium.

5. A method according to claims 1, 2, 3 or 4 wherein the second recording material comprises a screen member for controlling a flow of electrically charged particles therethrough, the second electrostatic image is of the same charge polarity as the first electrostatic image, and said impressing on the first electrostatic image an electric charge of polarity opposite that of the first electrostatic image comprises projecting a flow of charged particles of opposite polarity to the first electrostatic image on the first electrostatic image through the second recording material.

6. A method according to claim 5, wherein the first recording material is a photoconductive plate comprising a photoconductive layer on an electrically conductive support.

7. A method according to claim 5, wherein the second recording material is a screen-type photoconductive plate comprising an electrically conductive substrate having a plurality of holes defined therethrough and a photoconductive layer on one surface of the conductive substrate.

8. A method according to claim 7, wherein the screen-type photoconductive plate further comprises an insulating layer and an electrically conductive bias layer on a surface of the substrate opposite said one surface carrying the photoconductive layer.

9. A method according to claim 5, wherein said step of forming the second electrostatic image comprises exposing the second recording material to light through a filter which transmits light having substantially the same spectral distribution as that of the color portion of the original.

10. A method according to claim 9, wherein the filter is a dichroic filter.

11. A method according to claims 1, 2, 3 or 4, wherein the second electrostatic image is of opposite charge polarity with respect to the first electrostatic image.

12. A method according to claim 11, wherein the first recording material is a photoconductive plate comprising a photoconductive layer on an electrically conductive support.

13. A method according to claim 11, wherein the second recording material is a screen-type photoconductive plate comprising an electrically conductive substrate having a plurality of holes defined therethrough and a photoconductive layer on one surface of the conductive substrate.

14. A method according to claim 13, wherein the screen-type photoconductive plate further comprises an insulating layer and an electrically conductive bias layer on a surface of the substrate opposite said one surface carrying the photoconductive layer.

15. A method according to claim 11, wherein the second recording material is a photoconductive plate comprising a photoconductive layer on an electrically conductive support.

16. A method according to claim 11, wherein said step of forming the second electrostatic image comprises exposing the second recording material to light through a filter which transmits light having substantially the same spectral distribution as that of the color portion of the original.

17. A method according to claim 16, wherein the filter is a dichroic filter.

18. An electrophotographic apparatus for forming an electrostatic image of an original having a color portion and a black portion, comprising:

a rotary photoconductive drum member as a first recording material and comprising a peripheral photoconductive layer on a conductive drum surface;

a photoconductive member as a second recording material and disposed for operative movement to a position in which at least a portion of said photoconductive member oppositely faces said first recording material;

a plurality of developing units for developing an electrostatic image formed on the first recording material;

a mechanism for transporting a transfer sheet for receiving thereon a visible toner image developed on said first recording material; and a mechanism for imagewise projecting the image light from an original on both said first and said second recording materials through a dichroic filter interchangeably disposed with a second filter to separate the image light into a first image light in a color corresponding to one of the colors of the original and a second image light of complementary color to the fist image light;

said first image light being projected on said second recording material along a first light path and said second image light being projected on said first recording material along a second light path.

19. An apparatus according to claim 18, wherein said second recording material comprises a photoconductive drum member.

20. An apparatus according to claim 18, wherein said second recording material comprises a flat photoconductive plate.

21. An apparatus according to claims 19 or 20, wherein said first recording material is capable of bearing an electrostatic charge and said second recording material is capable of bearing an electrostatic charge of polarity opposite that receivable on the first recording material.

22. An electrophotographic apparatus for forming an electrostatic image of an original having a color portion and black portion, comprising:

a rotary photoconductive drum member as a first recording material and comprising a peripheral photoconductive layer capable of bearing an electrostatic charge and carried on a conductive drum surface;

a flat screen-type photoconductive plate as a second recording material and capable of bearing an electrostatic charge of the same polarity as that receivable on said first recording material, said screen-type plate being operatively movable along a linearly extending screen path which includes a portion oppositely facing said peripheral photoconductive layer of said rotary photoconductive drum member;

a charger for projecting charged particles on said peripheral photoconductive layer of the rotary drum member through said screen-type photoconductive plate and disposed opposite said peripheral photoconductive layer of the drum member;

a pair of developing units for developing an electrostatic image formed on the peripheral photoconductive layer of the drum member;

a mechanism for transporting a transfer sheet along a path therefor, said transfer sheet path being located closely adjacent said rotary drum member for enabling transfer of a visible toner image developed on said drum member onto a transfer sheet; and a mechanism for imagewise projecting the image light from an original onto both said rotary drum member and said screen-type plate through a dichroic filter interchangeably disposed with a second filter to separate the image light into a first image light in a color corresponding to one of the colors of the original and a second image light of complementary color with respect to said first image light;

said first image light being projected on said screen-type plate along a first light path and said second image light being projected on said rotary drum member along a second light path.

* * * * *